US008197115B2

(12) United States Patent
Wilkinson et al.

(10) Patent No.: US 8,197,115 B2
(45) Date of Patent: Jun. 12, 2012

(54) LUMINAIRE WITH ADJUSTABLE LIGHT SOURCE

(76) Inventors: Dean Andrew Wilkinson, Boise, ID (US); Nathan Howard Calvin, Boise, ID (US)

( * ) Notice: Subject to any disclaimer, the term of this patent is extended or adjusted under 35 U.S.C. 154(b) by 296 days.

(21) Appl. No.: 12/648,261

(22) Filed: Dec. 28, 2009

(65) Prior Publication Data

US 2010/0165616 A1 Jul. 1, 2010

Related U.S. Application Data

(60) Provisional application No. 61/141,654, filed on Dec. 30, 2008.

(51) Int. Cl.
*F21V 33/00* (2006.01)

(52) U.S. Cl. ..... 362/648; 362/248.02; 362/249.11

(58) Field of Classification Search ..... 362/648, 362/647, 249.02, 249.1, 238
See application file for complete search history.

(56) References Cited

U.S. PATENT DOCUMENTS

| | | | | |
|---|---|---|---|---|
| 2,716,185 | A | 8/1955 | Burkliuk et al. | |
| 3,377,481 | A | 4/1968 | Lasker | |
| 3,437,802 | A | 4/1969 | Intrator | |
| 4,238,815 | A | 12/1980 | Price | |
| 4,464,707 | A | 8/1984 | Forresst | |
| 5,217,296 | A * | 6/1993 | Tanner et al. | 362/183 |
| 5,340,322 | A * | 8/1994 | Poulsen | 439/111 |
| 5,695,279 | A * | 12/1997 | Sonnleitner et al. | 362/419 |
| 6,210,025 | B1 | 4/2001 | Schmidt et al. | |
| 6,220,726 | B1 | 4/2001 | Gordin | |
| 6,755,557 | B2 | 6/2004 | Stauner et al. | |
| 6,988,820 | B2 | 1/2006 | Drufva | |
| 7,311,423 | B2 | 12/2007 | Frecska | |
| 7,329,026 | B1 | 2/2008 | Hayman et al. | |
| 8,021,024 | B2 * | 9/2011 | Huang | 362/294 |
| 2008/0106892 | A1 | 5/2008 | Griffiths et al. | |

FOREIGN PATENT DOCUMENTS

DE WO/2009/098028 8/2009

OTHER PUBLICATIONS

XLEDs USA Specification Sheet for DLL-08 MR16 Type LED Downlight 2009 Web Site Catalog at http://www.xledsusa.com/SpecSheets/DLL-08.pdf XLEDs USA 3815 N. Brookfield Rd. Suite 104-144.

* cited by examiner

*Primary Examiner* — Anabel Ton
(74) *Attorney, Agent, or Firm* — Gerard Carlson

(57) ABSTRACT

Light sources in a luminaire attach to the luminaire by one or more tabs. Up to three axis of rotation are possible. Bendable tabs enable a first axis of rotation of the light source. Light sources are rotatable about a mounting point to the tab providing a second axis of rotation. Some tabs are twistable about a third axis of rotation. Some tabs also conduct heat away from the light source. Tabs can also be formed in a baffle plate for new luminaires or for the retrofit of existing luminaires. Multiple types of light sources can be combined to provide luminaires with custom light patterns and intensities.

15 Claims, 9 Drawing Sheets

LUMINAIRE WITH ADJUSTABLE LIGHT SOURCE

CROSS REFERENCE TO RELATED APPLICATIONS

This application claims the benefit of the provisional application entitled "Luminaire with Adjustable Light Source" by Dean Wilkinson and Nathan Calvin, Ser. No. 61/141,654 filed Dec. 30, 2008, and is hereby incorporated by reference in its entirety.

FEDERALLY SPONSORED RESEARCH OR DEVELOPMENT

Not applicable.

JOINT RESEARCH AGREEMENT

Not applicable

SEQUENCE LISTING

Not applicable

FIELD OF THE INVENTION

The present invention relates to the field of lighting fixtures also called luminaires, and in particular to lighting fixtures with adjustable illumination patterns.

BACKGROUND OF THE INVENTION

Currently for outdoor lighting, numerous types of luminaires exist. They differ not only in style but especially with respect to the illumination pattern. For example, sidewalks require long, narrow illumination patterns while traffic intersections require broader, wide area illumination patterns. Within the lighting industry there exists a number of standardized illumination patterns referred to as Type I, Type II, Type III, Type IV, etc.

Designers and installers of luminaires are required to specify, stock, supply and install many different luminaire types in order to achieve the required illumination pattern. More problematic are cases where local geography requires customized illumination patterns not easily met by standardized luminaire types.

SUMMARY OF THE INVENTION

The luminaire with adjustable light source can be configured from a reduced set of parts to form not only standardized illumination patterns such as Type I, Type II, Type III, Type IV, but also custom illumination patterns. The luminaire with adjustable light source is also uniquely suited to LED (light emitting diode) light sources.

In one embodiment a luminaire with an adjustable light source has a tab formed in the material of the luminaire, the tab being bendable about a first axis. The light source rotatably attaches to the tab and is rotatable about a second axis. In some embodiments the light source is in thermal contact with the tab, and the tab is in thermal contact with the luminaire to conduct heat away from the light source via the tab. In other embodiments the tab is twistable about a third axis to allow further aiming of the light source. In other embodiments the three axes are mutually orthogonal.

Still other embodiments of the luminaire with adjustable light source can use a number of different light sources on a mix and match basis. For example light sources can vary in light emission pattern from spot to flood or in intensity of the light. Depending upon the required lighting pattern a luminaire can employ a number of different types of light sources with various light emission patterns and emission intensities to achieve the required illumination pattern. This approach allows designers to achieve required light patterns with reduced wattage (reduced energy consumption).

Further embodiments can retrofit an existing luminaire that uses the energy consuming high pressure sodium or other types of older lamps. A replacement baffle plate adapts to fit into an existing luminaire replacing the older bulb and ballast. Tabs formed in the material of the baffle plate bend out of the baffle plate about a respective first axis and light sources rotatably attach to each of the tabs. The light sources are thus rotatable about a second axis with respect to each tab. This retrofit apparatus can use the structures discussed earlier to conduct heat away from the light source via the tab. It can also benefit from the twistable tab and the mix and match approach using various light sources. Vents can also be formed in the baffle plate or other luminaire structures to dissipate heat.

In still other embodiments the luminaire with an adjustable light source uses a baffle plate with tab-pairs formed in the material of the baffle plate. The tabs of the tab-pairs are bendable out of the surface of the baffle plate, and define a respective axis between them. Each of the light sources, rotatably attaches between one of the tab-pairs and rotates about the axis of the tab-pair. One or both of the tabs of the tab-pairs can be slotted so that the respective axis is adjustable between the tab-pairs. This allows further versatility in the aiming of each light source. As discussed earlier, the baffle plate with tab-pairs can also benefit from light sources that vary in pattern and intensity as well as thermal contacts and vents to conduct heat away from the light source.

BRIEF DESCRIPTION OF DRAWINGS

The summary above, and the following detailed description will be better understood in view of the enclosed drawings which depict details of preferred embodiments. Like reference numbers designate like elements. It should however be noted that the invention is not limited to the precise arrangement shown in the drawings. The features, functions and advantages can be achieved independently in various embodiments of the claimed invention or may be combined in yet other embodiments.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modification to the various disclosed embodiments may be made and other embodiments may be utilized, without departing from the spirit and scope of the present invention. The following detailed description is therefore, not to be taken in a limiting sense.

Figure 1:
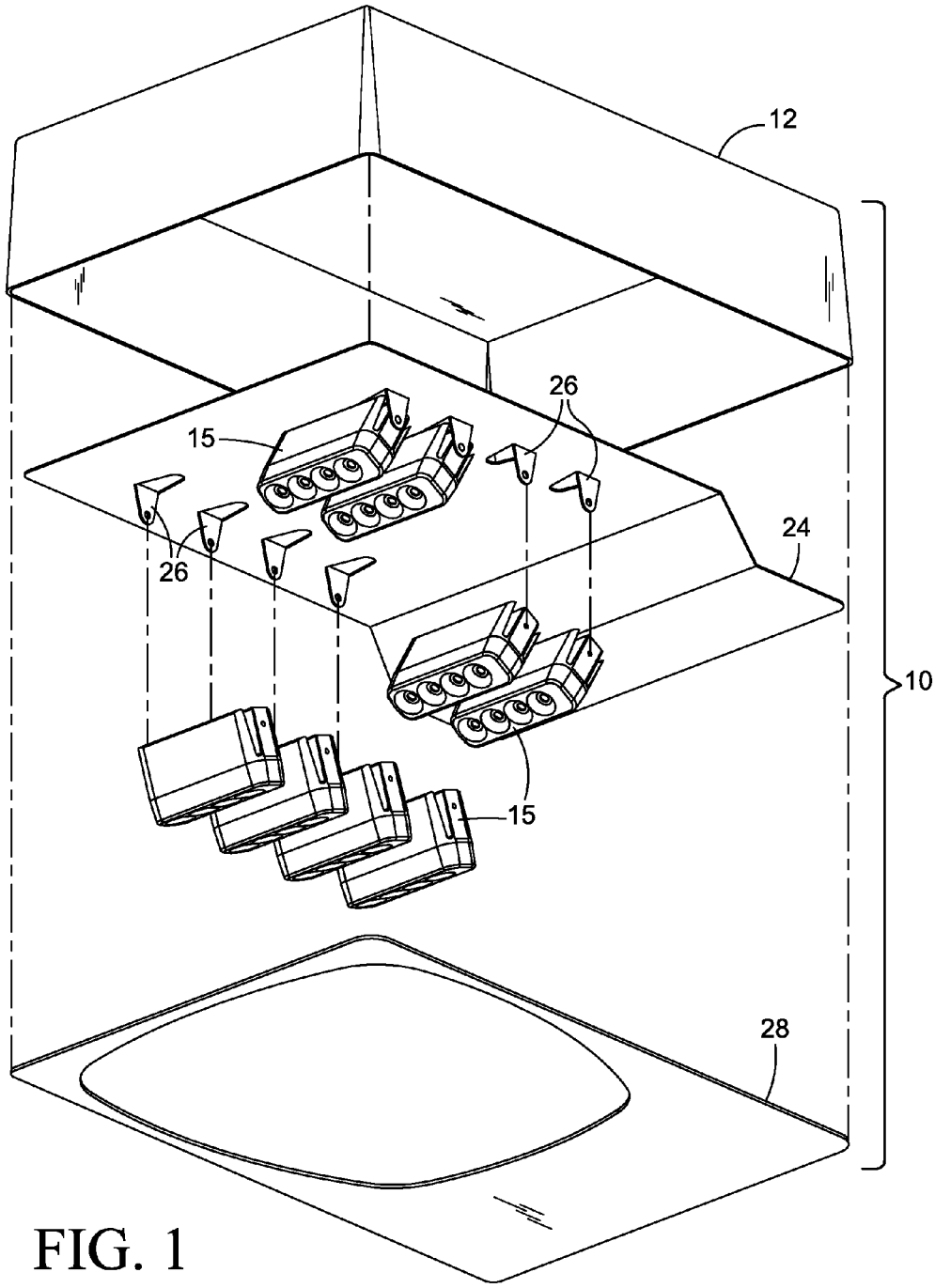
FIG. 1 shows an exploded view of one embodiment of a luminaire with an adjustable light source.
Figure 2:
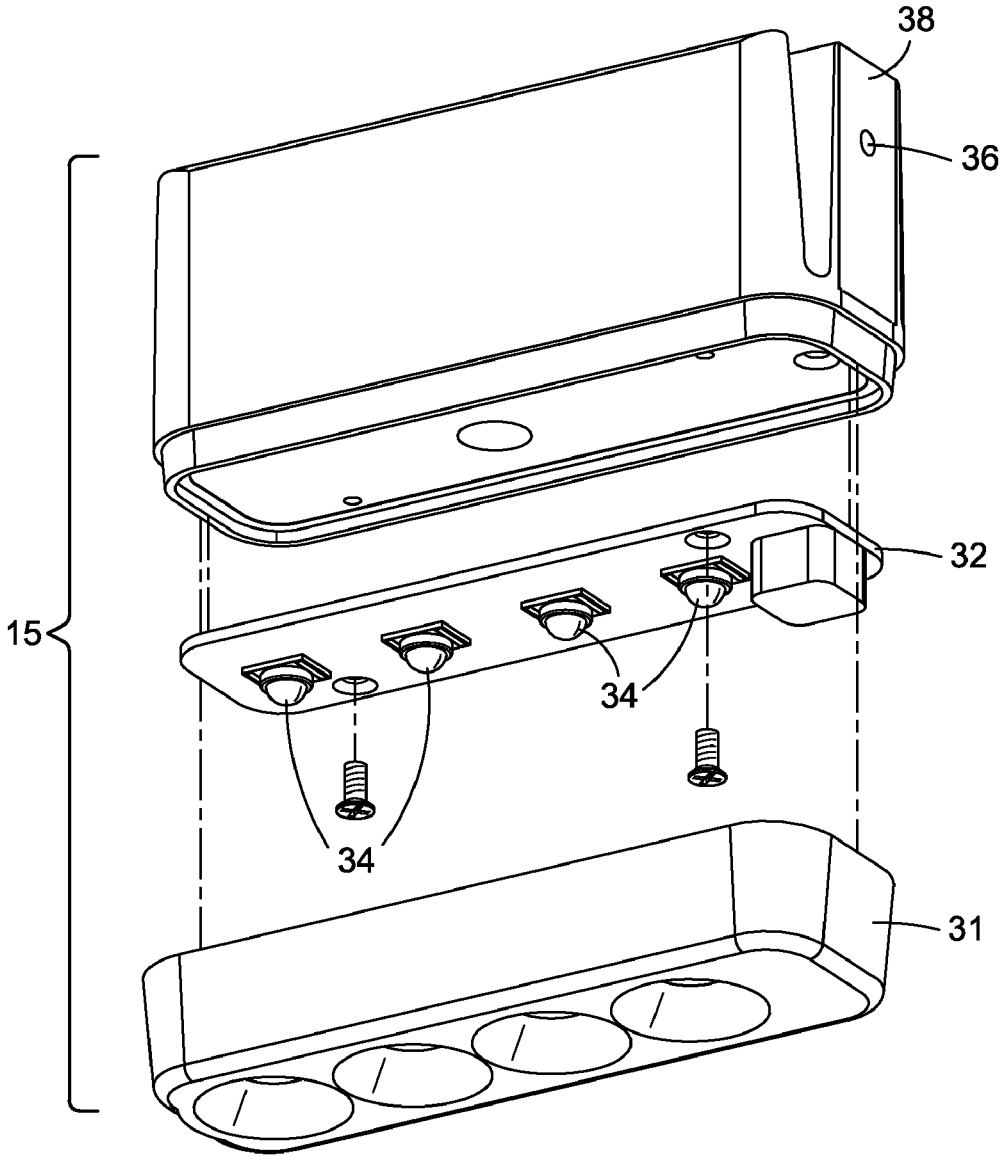
FIG. 2 shows an exploded view of one embodiment of a light source.

FIG. 1 shows an exploded view of one embodiment of a luminaire 10. The luminaire has a box 12 which acts as a cover for the luminaire components as well as a chassis for holding the components. Together, the box 12 and cover 28 form the luminaire body. In many cases a pole (not shown) elevates the luminaire 10 above a street or sidewalk to provide illumination. In other applications the luminaire 10 may be attached directly or by brackets to the wall or ceiling of a structure such as a parking garage. The box 12 make take many forms. Example box forms are named after their shapes such as "shoe box" or "cobra". The light sources 15 can vary in number. In this example, eight light sources are shown. In other embodiments, the number of light sources can vary from one to an unlimited number. The baffle plate 24 holds the light sources 15, by means of tabs 26. The light sources 15 are each supported on a corresponding tab 26. As will be described in more detail, the tabs 26, are bendable to adjust the direction in which the light sources project light FIG. 2 shows one embodiment of a light source 15. Four LEDs 34 mount to a circuit board 32. A lens and/or reflector 31 focuses and directs the light from the LEDs into the desired pattern. A heat sink 38 draws heat away from the LEDs and associated circuitry. The attachment point 36 allows the light source to be attached to a tab and adjusted through a range of angles. Greater detail and explanation of the adjustment follows. While the example light source in FIG. 2 uses four LEDs, other numbers of LEDs and light emitting elements are possible. Light sources may take other forms as well such as longer bar shape, square, oval or circular structures.

Figure 3:
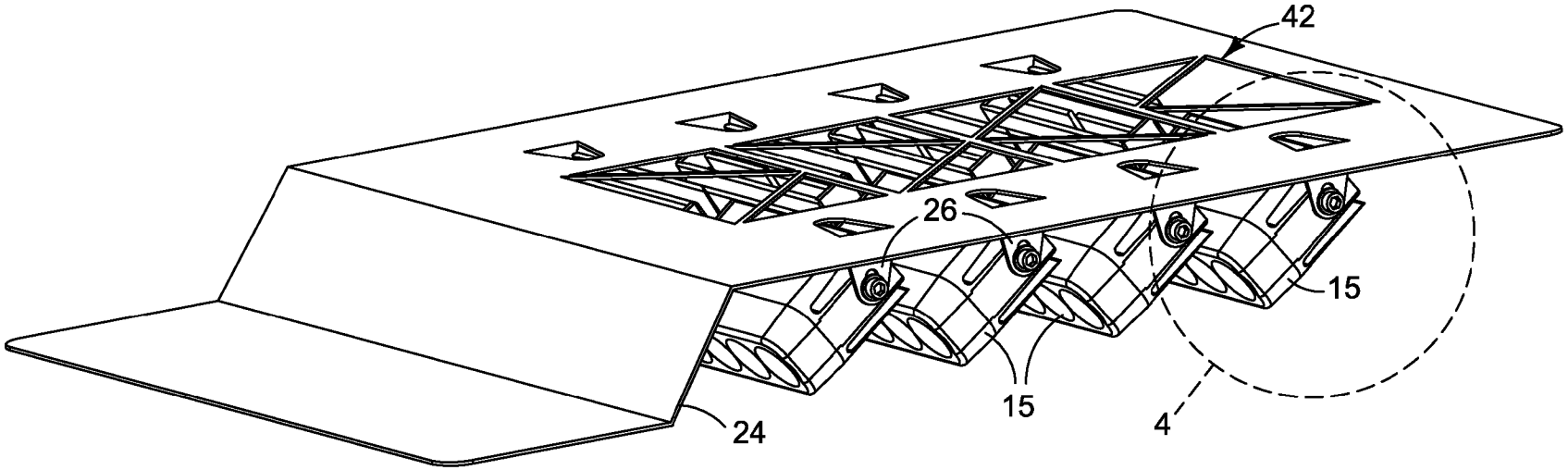
FIG. 3 shows one embodiment of a baffle plate with attached light sources.

FIG. 3 shows one embodiment of a baffle plate 24 and tabs 26. The tabs 26 function as mounting points for the light sources 15. As can be seen in FIG. 3, the tabs 26 are bendable out of the material from the major plane of the baffle plate 24. This bendable feature enables each light source 15 to be independently aimed. The tabs 26 also act to conduct heat away from the light sources 15. The light source 15 of FIG. 2 for example mounts to the tab 26 by means of the attachment point 36 and heat sink 38. This method of mounting puts the light source 15 in thermal contact with the tab 26 drawing heat away from the heat sink 38 and to the tab 26 and baffle plate 24. Additionally vents 42 aid in air circulation around the light sources 15 and associated heat sinks 38. When the baffle plate 24 is fitted to the box 12 or cover 28 of FIG. 1, the tabs 26 which are in thermal contact with the baffle plate 24 conduct heat to the luminaire 10. Heat is transferred from the light source 15 to the tab 26 to the baffle plate 24 and to the box 12 or cover 28.

Figure 4:
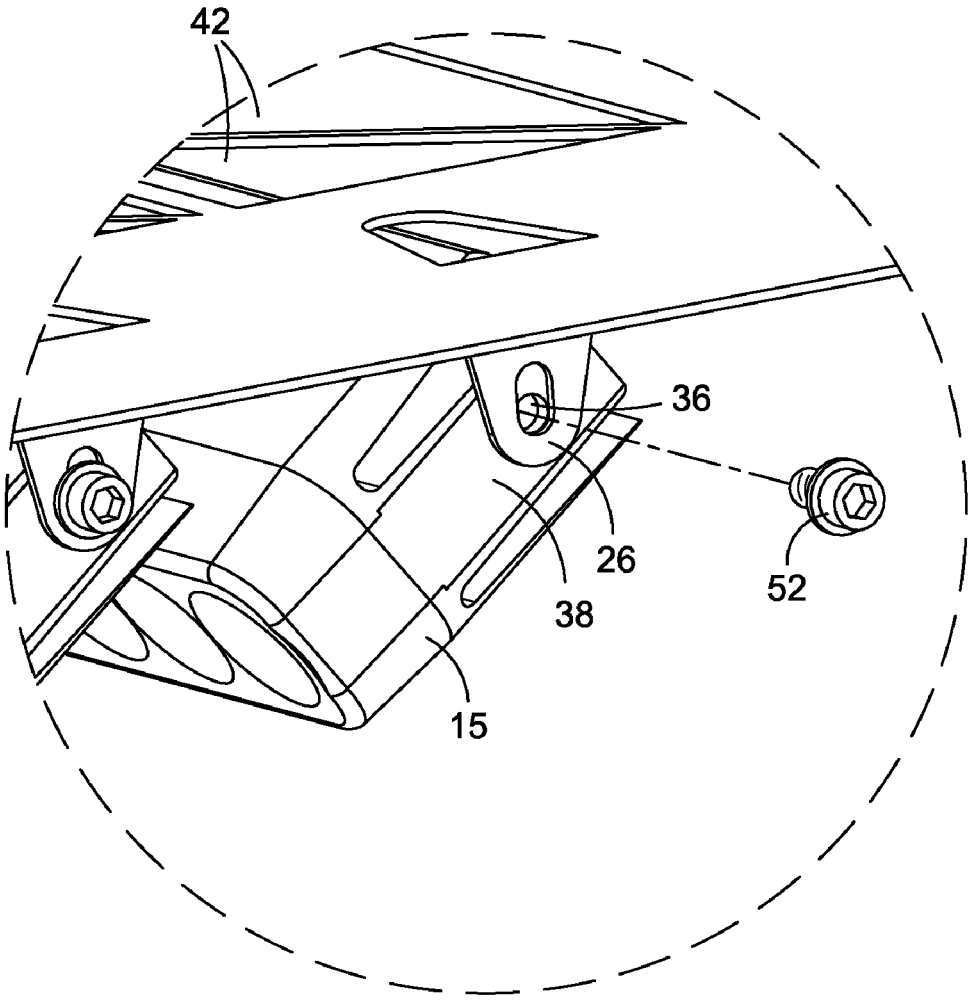
FIG. 4 shows details from FIG. 3 of one embodiment of light sources attached to tabs.

FIG. 4 is a detailed view of a portion of FIG. 3. FIG. 4 shows of one embodiment of the tab 26 and the attachment to the light source 15. In this embodiment the light source 15 is rotatably attached to the tab 26 as the screw 52 passes through the tab 26, the attachment point 36 and into the heat sink 38. This arrangement enables three axis of rotational adjustment. The first axis of rotation is achieved as the plane of the tab 26 is bent toward or away from the major plane of the baffle plate 24. The second axis of rotation is about the axis of the screw 52 as the light source rotates about the screw 52. The third axis of rotation occurs when the light source 15 swings around the tab as the body of the tab 26 is twisted. The three axes of rotation are described in further detail in the following figures. While this embodiment shows the use of a screw, a number of other fastening devices and techniques are possible including, but not limited to, snaps, clips, springs, detents, clamps and adhesives. Furthermore washers, bellville springs, and deformable or compressible materials can be used to improve heat flow between the tab and light source. Materials can also be selected to provide rotational friction between the tab and light source. This friction allows the light source to be rotated without loosening and retightening a fastener. A worker can rotatably adjust the light by rotating it against the friction. After adjustment, the friction holds the adjustment.

Figure 5:
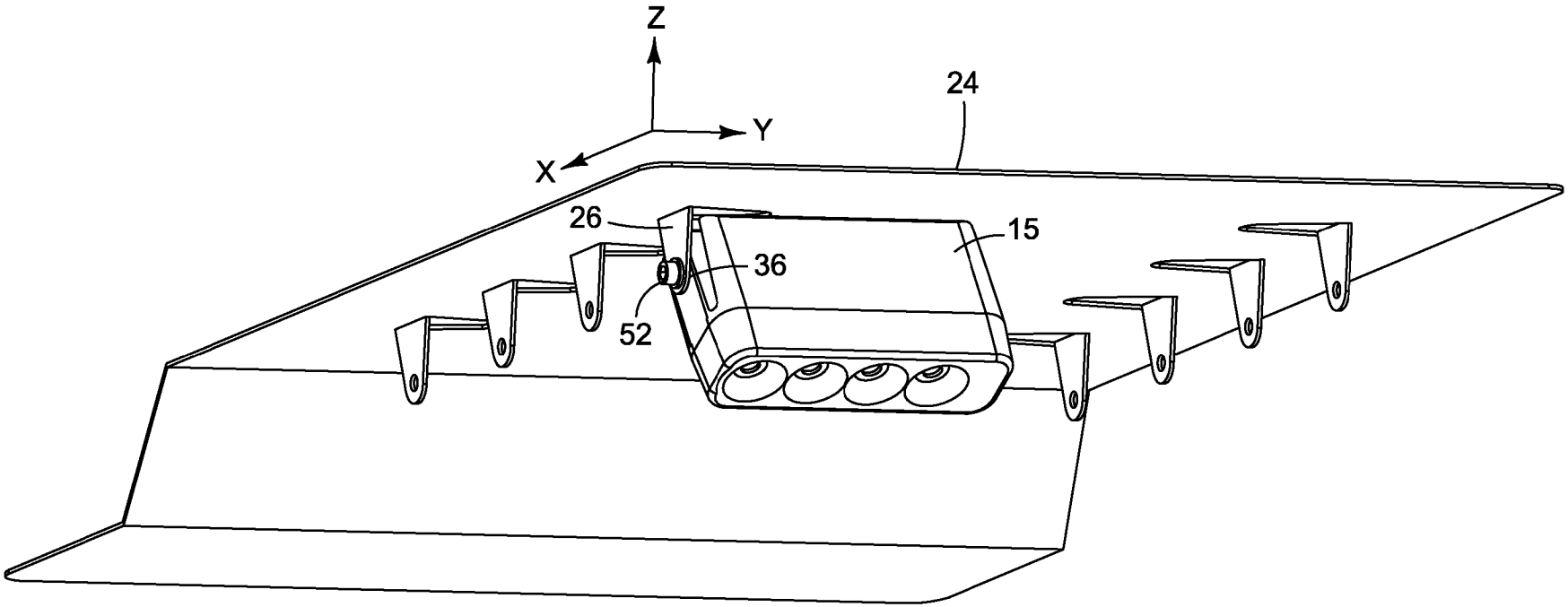
FIG. 5 shows one embodiment of baffle plate with an attached light source and reference axes.

FIG. 5 shows an example light source 15 attached to baffle plate 24 by tab 26 and screw 52 into attachment point 36. Although preferred embodiments of the baffle 24 may have more than one light source 15, FIG. 5 shows only one for clarity. Superimposed on the baffle 24 is a coordinate system of three axes, X, Y and Z. While the three axes are mutually orthogonal in FIG. 5, they can have other angular relationships. For example two of the axes can be orthogonal to each other or none of the axes need be orthogonal. This coordinate system is used in FIGS. 6, 7 and 8 to further explain the three degrees of rotational freedom available for aiming the light source 15.

Figure 6:
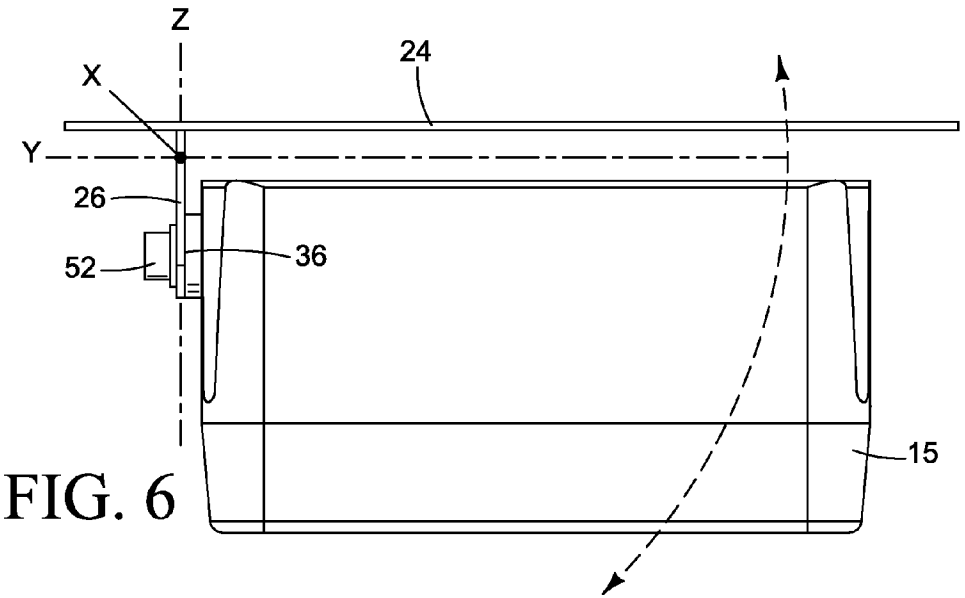
FIG. 6 shows one embodiment of a light source rotatably mounted to a tab.

FIG. 6 shows a side view of one embodiment of the light source 15 attached to baffle plate 24 via tab 26. Screw 52 and attachment point 36 attach the light source 15 to the tab 26. The X, Y, Z coordinate system of FIG. 5 is again shown in FIG. 6 with the X axis looking into the plane of the page. The tab 26 is bendable about the X axis which is generally located as shown. As the tab rotates toward or away from the major plane of the baffle plate 24 the light source 15 moves with it. The dashed arc depicts how the light source 15 can rotate around the X axis obtaining a first axis of rotational freedom.

Figure 7:
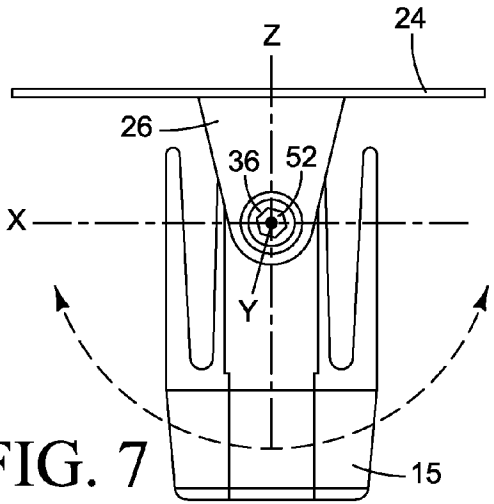
FIG. 7 shows one embodiment of a bendable tab with an attached light source rotatably mounted to a tab.

FIG. 7 shows an end view of one embodiment of the light source 15 attached to baffle plate 24 via tab 26. Screw 52 and attachment point 36 attach the light source 15 to the tab 26. The X, Y, Z coordinate system of FIG. 5 is again shown in FIG. 7 with the Y axis looking into the plane of the page along the axis of the screw 52. The dashed arc depicts how the light source 15 can rotate around the screw 52 obtaining a second axis of rotation. Thus the light source is rotatably attached to the tab, making the light source rotatable about a second axis.

Figure 8:
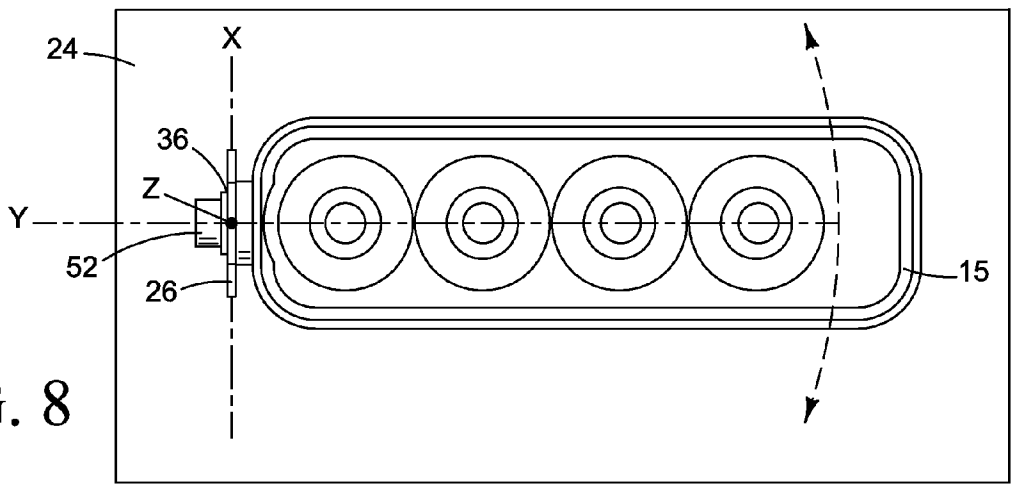
FIG. 8 shows one embodiment of a twistable tab with an attached light source rotatably mounted to a tab.

FIG. 8 shows a view of one embodiment of the light source 15 looking into the LEDs of the light source 15. Again, light source 15 attaches to baffle plate 24 via tab 26. Screw 52 and attachment point 36 attach the light source 15 to the tab 26. The X, Y, Z coordinate system of FIG. 5 is again shown in FIG. 8 with the Z axis looking into the plane of the page. The tab 26 is twistable about the Z axis generally located as shown. The dashed arc depicts how the light source 15 can rotate around the Z axis obtaining a third axis of rotational freedom. Thus the tab is twistable about a third axis.

Figure 9A:
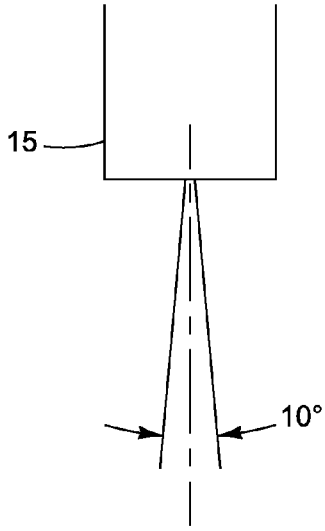
FIGS. 9A, 9B and 9C show embodiments of light sources with various light emission patterns.
Figure 9B:
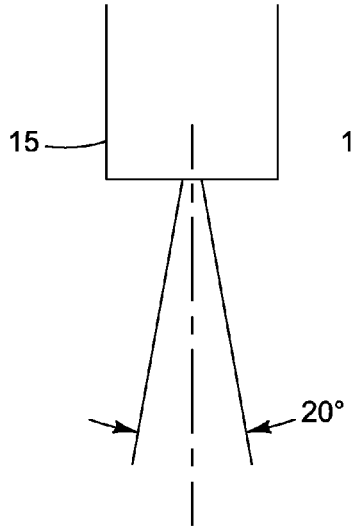
Figure 9C:
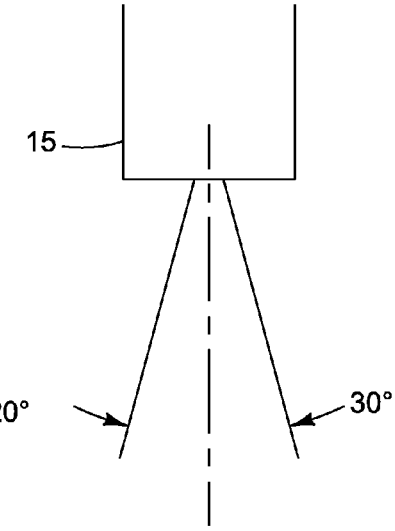

FIGS. 9A, 9B and 9C show three embodiments of light sources 15. The light sources differ by the projected angle of the light they cast. This example shows angles of 10, 20 and 30 degrees. Other angles are possible.

Figure 10A:
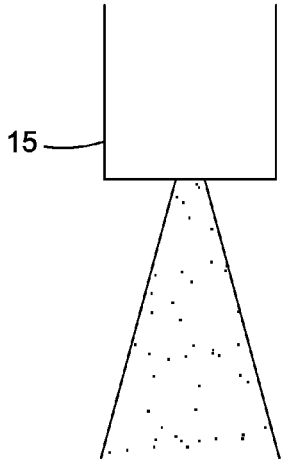
FIGS. 10A, 10B, and 10C show embodiments of light sources with various emission intensities.
Figure 10B:
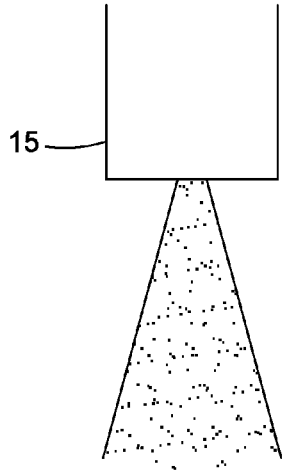
Figure 10C:
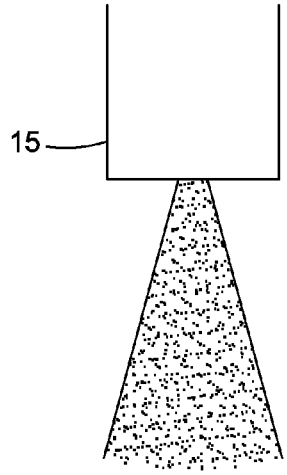

FIGS. 10A, 10B and 10C show three additional embodiments of light sources 15. The light sources differ by the intensity of the light they cast. LEDs and other light emitters can be sized. For example, one version of light source may use four 1 watt LEDs while another version might use four 3 watts LEDs. Numerous combinations of emission intensity, color and number of emitters are possible.

By combining light sources of various light emission patterns, and emission intensities in combination with one or more degrees of rotational freedom, a single baffle can provide a number of different overall illumination patterns.

Figure 11:
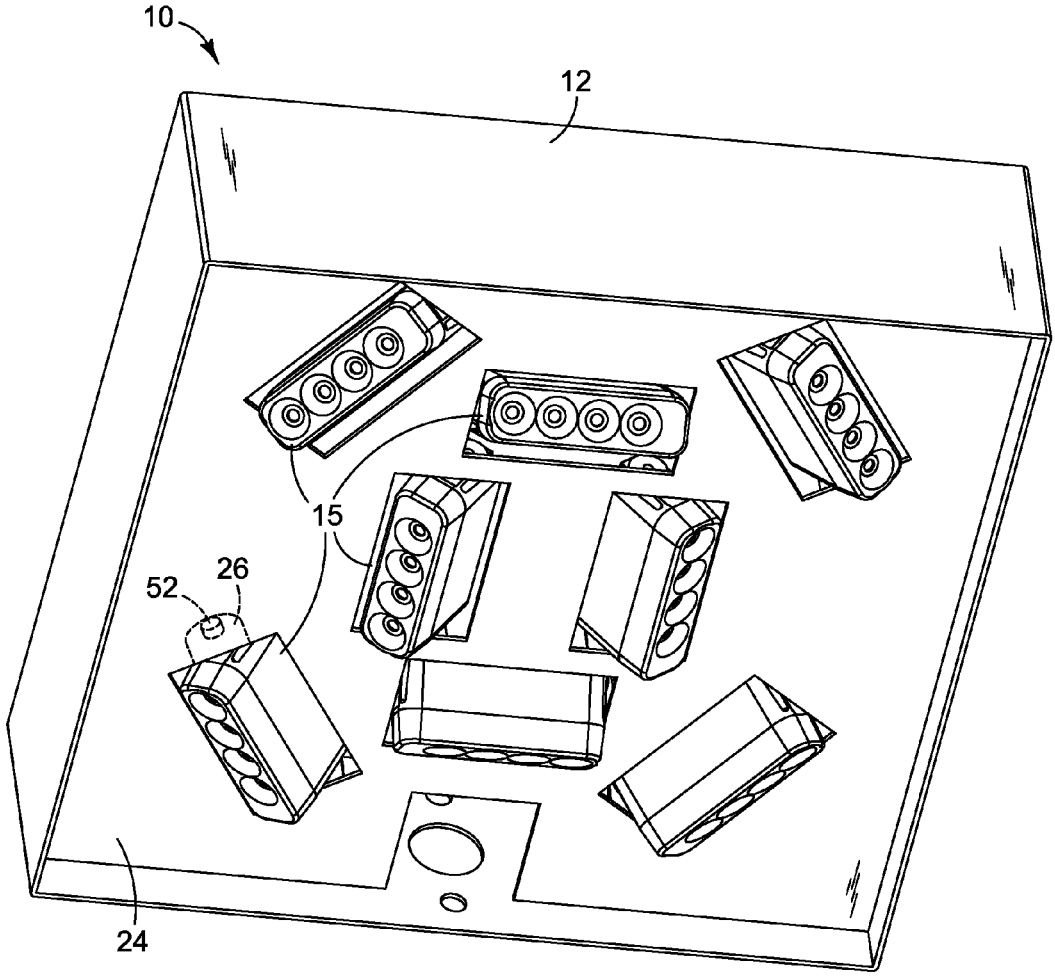
FIG. 11 shows an embodiment of a luminaire with tab-pairs supporting the light sources between them.

FIG. 11 shows another embodiment of a luminaire 10 with adjustable light sources 15. Baffle plate 24 has a number of tabs 26 of which one is shown with hidden lines. Screw 52 rotatably attaches light source 15 to tab 26. In the embodiment of FIG. 11, each light source 15 is suspended between two tabs 26. The tabs 26 of the tab-pair bend inward into the box 12 of the luminaire 10. These tap-pairs are shown in more detail in the following figure.

Figure 12:
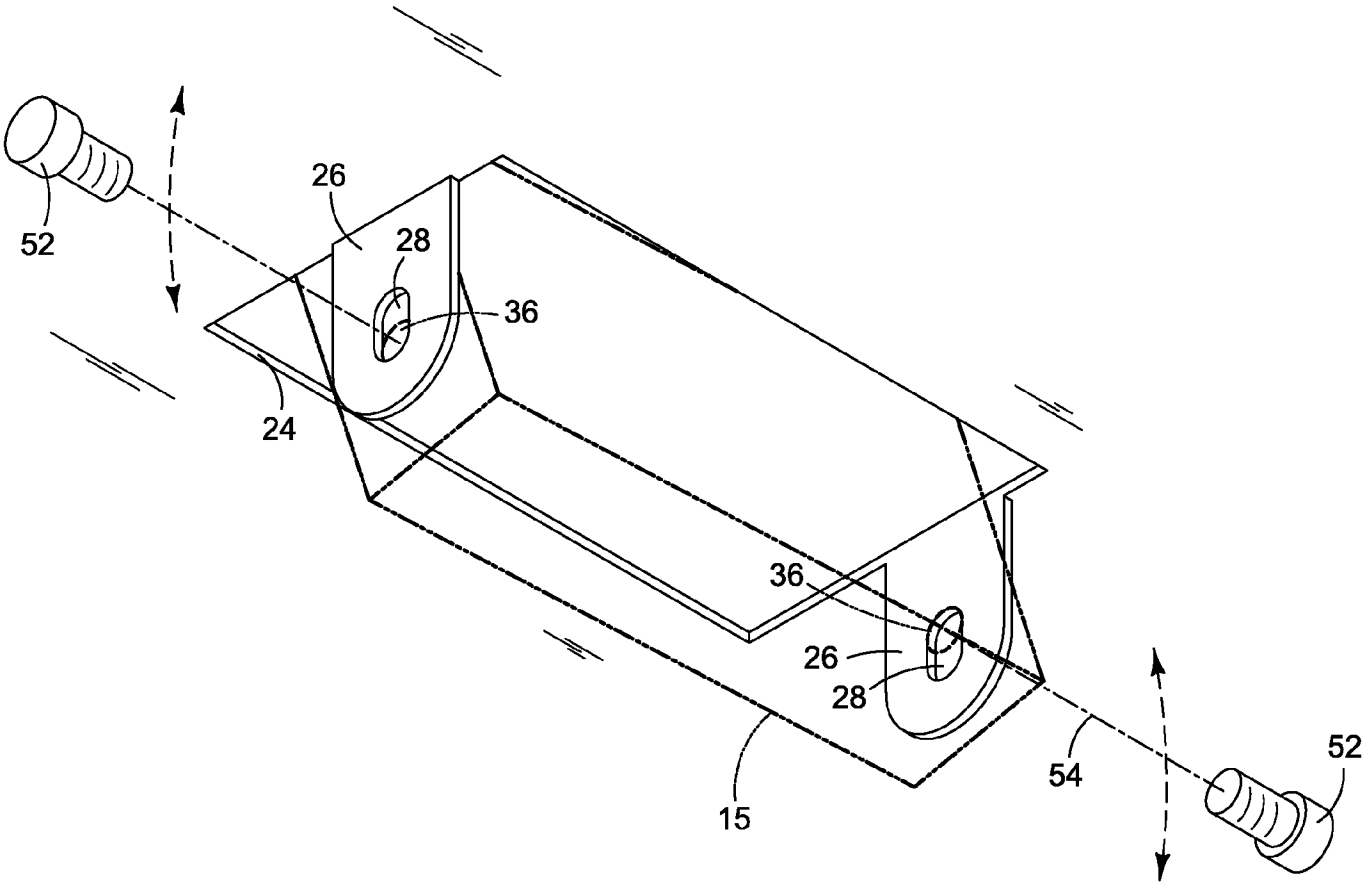
FIG. 12 shows an embodiment of a tab pair for supporting a light source.

FIG. 12 shows one embodiment of the tab-pair introduced in the discussion of FIG. 11. The view of FIG. 12 is from inside the box 12 of the luminaire 10 of FIG. 11. Two tabs 26 bend out of the material of the baffle plate 24 forming a tab-pair. The light source 15 with two attachment points 36 is shown in hidden lines Screws 52 rotatably attach the light source 15 to the tabs 26 which form the tab pair. Each tab-pair defines an axis 54 as indicated between the ends of the two screws. The holes 28 in each tab 26 are slotted. This allows the axis 54 to be adjustable as indicated by the curved dashed lines. The axis is adjusted by varying the location where the screws 52 are tightened in the slotted holes 28. The light source 15 is further rotatable about the axis 54. While FIG. 12 shows a single tab-pair, many luminaires employ multiple tab-pairs formed from the material of the baffle plate 24. The tabs 26 of the tab-pairs are bendable out of the surface of the baffle plate 24, each of the tab-pairs defining a respective axis between the tabs 26 of the tab-pair. Each light source 15 rotatably attaches between one of the tab-pairs. The light source rotates about the respective axis of the tab-pair. As with embodiments described earlier, one or more tabs 26 of a tab-pair can conduct heat away from the light source 15 into the baffle plate 24.

In other embodiments, the baffle plates can be designed to retrofit existing luminaires. The retrofit can save cost and material waste by reuse of many of the existing luminaire components while still offering the advantages of an upgraded light source. Embodiments of the luminaire allow the light projection pattern of the luminaire to be adjusted on site. This is especially useful in applications where stray light can be a nuisance to residences. Other applications include situations where the desired light pattern does not fit one of the standard lighting patterns.

The luminaire with adjustable light sources also provides the advantage of a modular kit approach. By stocking a limited type of light sources and baffles, a technician can create numerous versions of luminaire by mixing, matching and adjusting the various light sources and baffles. For example one baffle type may have two tabs for two light sources while another baffle type may have tabs for eight light sources. Depending upon the overall area to be illuminated and the intensity desired, a technician can choose the number and type of light sources needed and a baffle to hold them. In other applications, a luminaire can be built with a partially populated baffle, that is, a baffle with less light sources than tabs Although this invention has been described in terms of certain preferred embodiments, other embodiments that are apparent to those of ordinary skill in the art, including embodiments that do not provide all of the features and advantages set forth herein, are also within the scope of this invention. Rather, the scope of the present invention is defined only by reference to the appended claims and equivalents thereof.

We claim:

1. An apparatus adaptable to a luminaire the apparatus comprising:

a baffle plate adapted to fit into the luminaire;

a plurality of tabs formed in the baffle plate, each of the tabs being bendable out of the baffle plate about a respective first axis; and a plurality of the light sources, each of the light sources rotatably attached to one of the plurality of tabs, each light source rotatable about a respective second axis.

2. The apparatus of claim 1 wherein the first axis and the second axis are mutually orthogonal.

3. The apparatus of claim 1 further comprising each light source in thermal contact with a respective tab, each of the plurality of tabs in thermal contact with the baffle plate.

4. The apparatus of claim 1 wherein each light source is chosen from a group of light sources, the members of which are distinguished by various light emission patterns.

5. The apparatus of claim 1 wherein each light source is chosen from a group of light sources, the members of which are distinguished by various light emission intensities.

6. The apparatus of claim 1 wherein each light source is chosen from a group of light sources, the members of which are distinguished by various light emission intensities and light emission patterns.

7. The apparatus of claim 1 further comprising one or more vents in the baffle plate.

8. The apparatus of claim 1 wherein each of the plurality of tabs being twistable about a third respective axis.

9. The apparatus of claim 8 wherein the first axis, second axis and third axis are mutually orthogonal.

10. A luminaire comprising:

a baffle plate adapted to fit into the luminaire;

a plurality of tab-pairs formed from the material of the baffle plate, the tabs of the tab-pairs being bendable out of the surface of the baffle plate, each of the tab-pairs defining a respective axis between the tabs of the tab-pair; and a plurality of light sources, each light source rotatably attached between one of the plurality of tab-pairs, the light source rotatable about the respective axis of the tab-pair.

11. The luminaire of claim 10 further comprising each light source in thermal contact with at least one of the tabs of the tab-pairs, the tab in thermal contact with the light source also being in thermal contact with the baffle plate.

12. The luminaire of claim 10 wherein at least one of the tabs of the tab-pairs is slotted whereby the respective axis is adjustable between the tab-pairs.

13. The luminaire with of claim 10 wherein each light source is chosen from a group of light sources, the members of which are distinguished by various light emission patterns.

14. The luminaire of claim 10 wherein each light source is chosen from a group of light sources, the members of which are distinguished by various light emission intensities.

15. The luminaire of claim 10 further comprising one or more vents in the baffle plate.

* * * * *